US010702120B2

(12) United States Patent
Naghsh et al.

(10) Patent No.: US 10,702,120 B2
(45) Date of Patent: Jul. 7, 2020

(54) MANUALLY OPERATED EXTENDABLE CLEANING DEVICE

(71) Applicant: Solmaz Naghsh, Paso Robles, CA (US)

(72) Inventors: Solmaz Naghsh, Paso Robles, CA (US); Kenneth E. Irwin, Jr., Dawsonville, GA (US)

(73) Assignee: Solmaz Naghsh, Paso Robles, CA (US)

( * ) Notice: Subject to any disclaimer, the term of this patent is extended or adjusted under 35 U.S.C. 154(b) by 205 days.

(21) Appl. No.: 16/014,316

(22) Filed: Jun. 21, 2018

(65) Prior Publication Data

US 2019/0099053 A1 Apr. 4, 2019

Related U.S. Application Data

(60) Provisional application No. 62/606,679, filed on Oct. 2, 2017.

(51) Int. Cl.
*A47L 13/258* (2006.01)
*A47L 13/256* (2006.01)
(Continued)

(52) U.S. Cl.
CPC ..... *A47L 13/258* (2013.01); *A47L 13/24* (2013.01); *A47L 13/254* (2013.01); *A47L 13/256* (2013.01); *B25G 1/02* (2013.01)

(58) Field of Classification Search
CPC ..... A47L 13/20; A47L 13/24; A47L 13/254; A47L 13/256; A47L 13/258
(Continued)

(56) References Cited

U.S. PATENT DOCUMENTS 1,784,567 A 12/1930 Aultman
2,614,281 A 10/1952 Clark
(Continued)

FOREIGN PATENT DOCUMENTS

DE 835333 * 3/1952
EP 2055222 * 5/2009
(Continued)

OTHER PUBLICATIONS

English Language Translation of Specification and Claims of European Patent No. EP 2055222.

*Primary Examiner* — Mark Spisich
(74) *Attorney, Agent, or Firm* — Panitch Schwarze Belisario & Nadel LLP

(57) ABSTRACT

A manually operated cleaning device extends reach and cleaning functionality to low clearance areas. The cleaning device has a base foot portion including at least one base foot portion cleaning surface. A flexible extendable cleaning implement is attached at one end to the base foot region. A flexible extendable cleaning implement cleaning surface is attached to at least one side of the flexible extendable cleaning implement. A handle is attached via a pivotal mounting to either the base foot portion or the flexible extendable cleaning implement. A releasable fastener operatively couples the flexible extendable cleaning implement to the base foot portion and allows extension and retraction of the flexible extendable cleaning implement between a stowed position on top of the base foot region when the manually operated cleaning device is not in use and an elongated position allowing the manually operated cleaning device to access the low clearance floor areas.

6 Claims, 8 Drawing Sheets

(51) Int. Cl.

| | |
|---|---|
| ***A47L 13/24*** | (2006.01) |
| ***A47L 13/254*** | (2006.01) |
| ***B25G 1/02*** | (2006.01) |

(58) Field of Classification Search
USPC ..... 15/228
See application file for complete search history.

(56) References Cited

U.S. PATENT DOCUMENTS

| | | | | | |
|---|---|---|---|---|---|
| 2,756,453 | A | | 7/1956 | Mattson | |
| 2,860,360 | A | | 11/1958 | Leavelle | |
| 3,911,521 | A | | 10/1975 | Franchot | |
| 4,731,897 | A | * | 3/1988 | Griffin | A47L 13/254 15/147.1 |
| 4,794,663 | A | | 1/1989 | Vosbikian | |
| 4,845,800 | A | * | 7/1989 | Pederson | A47L 13/20 15/228 |
| 4,908,900 | A | | 3/1990 | McLaughlin et al. | |
| 6,155,620 | A | | 12/2000 | Armstrong | |
| 6,474,896 | B1 | | 11/2002 | DeLaine, Jr. | |
| 7,178,190 | B2 | | 2/2007 | Jones et al. | |
| 8,850,651 | B1 | * | 10/2014 | Carman | A47L 13/24 15/228 |
| 2003/0140441 | A1 | | 7/2003 | Stafford | |
| 2014/0201936 | A1 | * | 7/2014 | Yang | A47L 13/38 15/231 |

FOREIGN PATENT DOCUMENTS

| | | | |
|---|---|---|---|
| JP | 7-327904 | * | 12/1995 |
| JP | 2004-329640 | * | 11/2004 |
| JP | 2014-321 | * | 1/2014 |

* cited by examiner (PRIOR ART — "VOSBIKIAN")

MANUALLY OPERATED EXTENDABLE CLEANING DEVICE

CROSS-REFERENCE TO RELATED APPLICATION

This application claims the benefit of U.S. Patent Application No. 62/606,679, filed Oct. 2, 2017, the disclosure of which is hereby incorporated herein by reference in its entirety.

FIELD OF THE INVENTION

The present invention relates generally to a device for extending the reach and consequently cleaning capability of a floor mop to include narrow and low clearance areas. The novel features of the invention are the various embodiments of a retractable low clearance extension thereby enabling a prior art dust mop to extend cleaning into spaces or areas that were heretofore unreachable with prior art mops.

BACKGROUND

This invention relates to improvements in cleaning implements. Specifically, this invention relates to improvements in mops enabling cleaning efficiencies heretofore unrealized.

When mopping a floor, it is often desirable and necessary to clean an area of floor that is substantially blocked by a low clearance overhang from a large object (e.g., sofa, refrigerator) such that it is difficult to clean the area blocked by the low clearance overhang without moving or removing the large object. Thus, the problem of efficiently cleaning these low clearance inaccessible floor areas persists, with recognized solutions ranging from moving the obstructing object to the human operator laying down and assuming a horizontal position with an extended cleaning implement to access the floor area substantially blocked by the large object low clearance overhang.

The problem of increasing the area of a floor engaged by a cleaning implement, such as the fabric head of a dust mop, has of course been recognized and has been dealt with by those principally involved in cleaning large floor areas, such as those of industrial plants or retail establishments. See, for example, U.S. Pat. No. 1,784,567 ("Aultman"); U.S. Pat. No. 2,614,281 ("McLaughlin"); U.S. Pat. No. 2,756,453 ("Mattson"); U.S. Pat. No. 2,860,360 ("Leavelle"); U.S. Pat. No. 3,911,521 ("Franchot"); U.S. Pat. No. 4,908,900 ("McLaughlin et. al."); U.S. Pat. No. 6,155,620 ("Armstrong"); U.S. Pat. No. 6,474,896 ("DeLaine, Jr."); and U.S. Pat. No. 7,178,190 ("Jones et. al."). However, these types of cleaning devices are typically large in size and consequently cumbersome and in some cases not suitable for home use. Additionally, all of these inventions require relatively high ground clearance to accommodate static (e.g., "Armstrong") or dynamic (e.g., "Franchot") arms that secure the cleaning implement surface to the handle thereby increasing ground clearance requirements and therefore making the device unsuitable for cleaning in those environments.

Some attempts to mitigate the problem of low clearance have been attempted with the development of flexible cleaning implements that do not require static or dynamic arms e.g., U.S. Pat. No. 4,794,663 ("Vosbikian") and U.S. Patent Application Publication No. 2003/0140441 ("Stafford"). However, while not requiring backing arms, these flexible cleaning implements nevertheless fail to extend substantially under large objects with low clearance. While "Vosbikian" does attempt to address the problem of cleaning floor areas under large low clearance objects (e.g., FIG. 4, which is itself a copy of FIG. 8 of "Vosbikian"), the device's reach is again limited so long as the human operator remains in a vertical (i.e., standing) position. Furthermore, the "Vosbikian" connecting bracket (i.e., prior art FIG. 4, view number "32" of "Vosbikian") substantially increases the minimum ground clearance of the overhang thereby reducing the device's utility in all but the highest overhanging areas. Thus, as before, these inventions still require a human operator to assume a horizontal position for all but perimeter cleaning of large objects with low clearance and still require relatively high ground clearance.

It is therefore desirable to develop mechanisms to clean any area of flooring that is substantially blocked by a low clearance overhang from a large object without lifting or moving the object. Ideally, these mechanisms would allow the human operator to clean the floor area substantially blocked by a large object overhang while remaining in a vertical and therefore standing position.

BRIEF SUMMARY OF THE INVENTION

Objects and advantages of the invention will be set forth in part in the following description, or may be obvious from the description, or may be learned through practice of the invention.

Described are mechanisms, systems, and methodologies related to a human operator standing in an upright position while cleaning any area of flooring that is substantially blocked by a low clearance without the need to lift or move the large object. In a general embodiment, the basic functionality of this invention is principally derived from extending a flexible cleaning implement surface substantially beyond the base footprint of the mop or cleaning utensil. The extendable cleaning implement being flexible or hinged in nature with no supporting arm required, thereby ensuring an extremely low profile that can easily pass under virtually all low clearance areas. Of course, the extendable cleaning implement of this invention should also be of sufficient elongated length to ensure access to all areas covered by an overhanging large object.

Briefly stated, one embodiment of the invention is directed to a manually operated cleaning device that extends reach and cleaning functionality to low clearance areas. The cleaning device has a base foot portion including at least one base foot portion cleaning surface. A flexible extendable cleaning implement is attached at one end to the base foot region. A flexible extendable cleaning implement cleaning surface is attached to at least one side of the flexible extendable cleaning implement. A handle is attached via a pivotal mounting to either the base foot portion or the flexible extendable cleaning implement. A releasable fastener operatively couples the flexible extendable cleaning implement to the base foot portion and allows extension and retraction of the flexible extendable cleaning implement between a stowed position on top of the base foot region when the manually operated cleaning device is not in use and an elongated position allowing the manually operated cleaning device to access the low clearance floor areas.

In a specific embodiment, the extendable cleaning implement is deployed in a spooled fashion from one end attached to the mop or cleaning utensil at its base near the handle portion. This embodiment has the advantage of ease of removal for cleaning or replacement of the extendable cleaning implement with only one pressure clamp necessary to secure the extendable cleaning implement surface to the mop's or cleaning utensil's main body. However, this embodiment has the disadvantages of requiring the human operator to either bend over or lift the mop to deploy and retract the extendable cleaning implement surface. In a preferred specific embodiment, the spooled extendable cleaning implement is deployed and retracted with an automated mechanism thereby eliminating the need for the human operator to bend over or lift the mop with the disadvantages of greater complexity, weight, and cost.

In another specific embodiment, the extendable cleaning implement is deployed in an unfolding fashion such that a simple mechanism can release and refold the extendable cleaning implement without the need for the human operator to significantly bend over. This embodiment having the advantages of ergonomics and simplicity of design with the possible disadvantage of a more complex removal process for cleaning or replacement of the extendable cleaning implement.

With all of the embodiments, the extendable cleaning implement may optionally include cleaning surfaces on both its top and bottom. The dual surfaces of this embodiment cleaning both the floor area as well as the bottom of the obstructing large object at the same time. With this embodiment, it is essential that both the top and bottom cleaning surfaces be easily compressible to ensure that the extendable cleaning implement will fit under low clearance obstructions.

Described are a number of mechanisms and methodologies that provide practical details for reliably allowing a human operator standing in an upright position to clean areas of flooring that are substantially blocked by a low clearance large object without the need to lift or move the large object. Although the examples provided herein are primarily related to mops, it is clear that the same methods are applicable to any type of cleaning utensil that requires access to any area of flooring that is substantially blocked by a low clearance large object.

DETAILED DESCRIPTION OF THE INVENTION

Figure 1A:
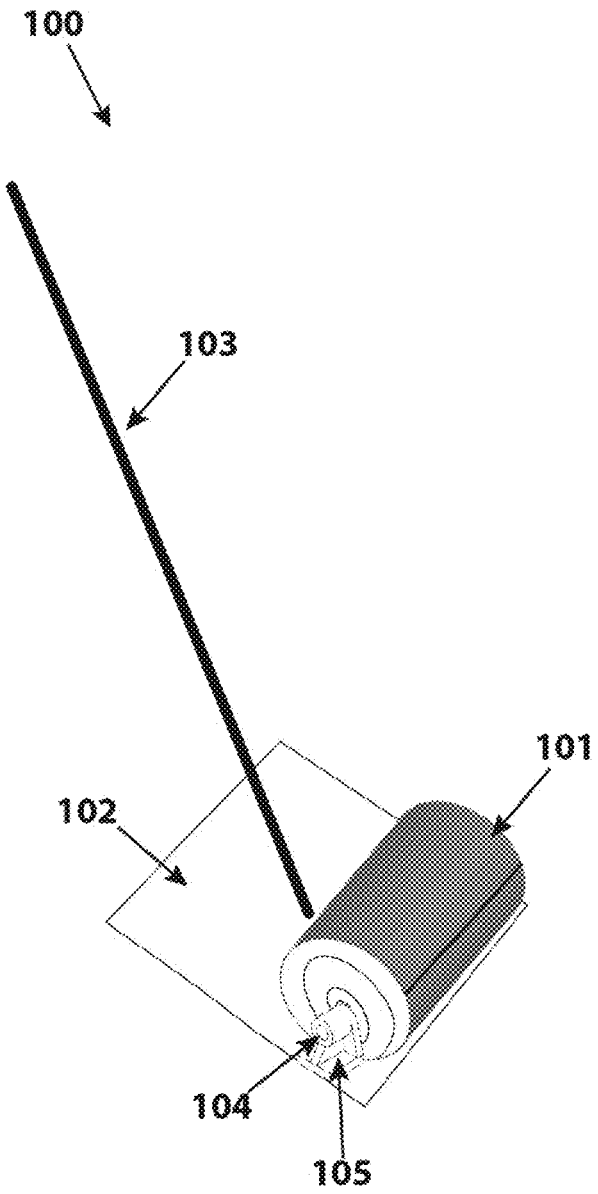
FIG. 1A is a first representative example of an isometric view of an extendable cleaning implement attached to a conventional dust mop in a spooled deployment embodiment in accordance with the present invention.

Certain terminology is used herein for convenience only and is not to be taken as a limitation on the present invention. The words "a" and "an", as used in the claims and in the corresponding portions of the specification, mean "at least one." Also, the terms "mop" and "cleaning utensil" are used interchangeably throughout the specification. Additionally, the term "extendable cleaning implement" refers to the entire extendable implement assembly that is key to this invention, while the term "extendable cleaning surface" refers to the cleaning surface itself that is a portion of the "extendable cleaning implement." In the context of this invention, the word "flexible" denotes the ability to be easily extendable and retractable and does not necessarily mean bending easily without breaking, though in some embodiments (e.g., FIGS. 1A thru 1C) the bending interpretation would also be applicable. Finally, as used herein, the terms "multi" or "multiple" or similar terms means at least two, and may also mean three, four, or more, for example, unless otherwise indicated in the context of the use of the terms.

Reference will now be made in detail to examples of the invention, one or more embodiments of which are illustrated in the drawings. Each example is provided by way of explanation of the invention, and not meant as a limitation of the invention. For example, features illustrated or described as part of one embodiment, may be used with another embodiment to yield still a further embodiment. The present invention encompasses these and other modifications and variations as come within the scope and spirit of the invention.

FIG. 1A depicts a first representative example 100 of this invention principally derived from extending a flexible cleaning implement 101 substantially beyond the base footprint 102 of the mop or cleaning utensil. The extendable cleaning implement 101 being flexible in nature and spooled into a stored position 101 such that it rests on top of the base foot 102 of the mop itself. With this invention, there is no supporting arm or backing attached to the extendable cleaning implement 101 with the flexible substrate 127 (FIG. 1B) of the cleaning surface being comprised of a substance that is water proof, flexible, and with sufficient strength and tear resistance to ensure that the cleaning implement surface 101' retains its shape without buckling when extended. Examples of suitable backing materials for the extendable cleaning implement surface 127 are: commercial-grade thermoplastic weaves (e.g., Tigressa® H2O™) polypropylene weaves, SoftBac®, and tightly woven polypropylene backing with close formed backing "cells." The extendable cleaning surface 128 itself can be comprised of any of the multiplicities of dust mop materials readily known to those skilled in the art—e.g., treated loop-end cotton yarn, four-ply HyGrade cotton. Preferably, the extendable cleaning surface 128 should exhibit antimicrobial and launder-able characteristics. Additionally, the extendable cleaning surface 128 material should also extend to cover the bottom of the base footprint 102 (FIG. 1A) of the mop or cleaning utensil.

As previously stated, it is essential that the extendable cleaning implement 101 exhibit an extremely low profile (e.g., less than 0.5 inch-1.27 cm) such that it can easily pass under virtually all low clearance areas. Of course, the extendable cleaning implement 101 should also be elongated to sufficient length (e.g., two to three feet—≈61 to 91 cm) to ensure access to all areas covered by an overhanging large object. In an optional embodiment, the extendable cleaning implement 101 may include cleaning surfaces on both sides of its substrate cleaning both the floor area as well as the bottom of the obstructing large object at the same time. With this optional embodiment, it is essential that both the top and bottom cleaning surfaces be easily compressible to ensure that the extendable cleaning implement will fit under low clearance obstructions.

Returning to the first representative example 100 of FIG. 1A, the extendable cleaning implement 101 can be stored in a spooled position, resting on top of the base foot 102 of the mop itself. As is typical, a handle 103 is attached on a pivotal mounting on the mop base foot 102. The extendable cleaning implement 101 is fastened to the base foot 102 of the mop via a retractable spring-loaded pressure clamp releasable fastener (129 of FIG. 1B and 129' of FIG. 1C) with sufficient spring torsional force to secure the extendable cleaning implement 101 (FIG. 1A) during normal operation yet also allow a human to easily release the pressure on the clamp to remove the extendable cleaning implement 101 for washing or replacement. To assist a human operator in releasing the extendable cleaning implement 101, the spring-loaded pressure clamp releasable fastener 129 (FIG. 1B) may include a folding lever arm that would thereby increase the leverage exerted by the human operator or, alternatively, a separate latching locking bar that releases all pressure on the extendable cleaning implement 101 (FIG. 1A) when unlatched could also be employed.

In an optional preferred embodiment, the spooled extendable cleaning implement 101 can be extracted and retracted by a battery powered motorized mechanism 105 driving the core 104 of the extendable cleaning implement 101 with rotary motion. With this embodiment, a small direct current motor (the battery powered motorized mechanism 105) would preferably be aligned with the core 104 shaft with its battery power source typically housed in the mop's handle 103 thereby reducing the mass of the mop head.

Figure 1B:
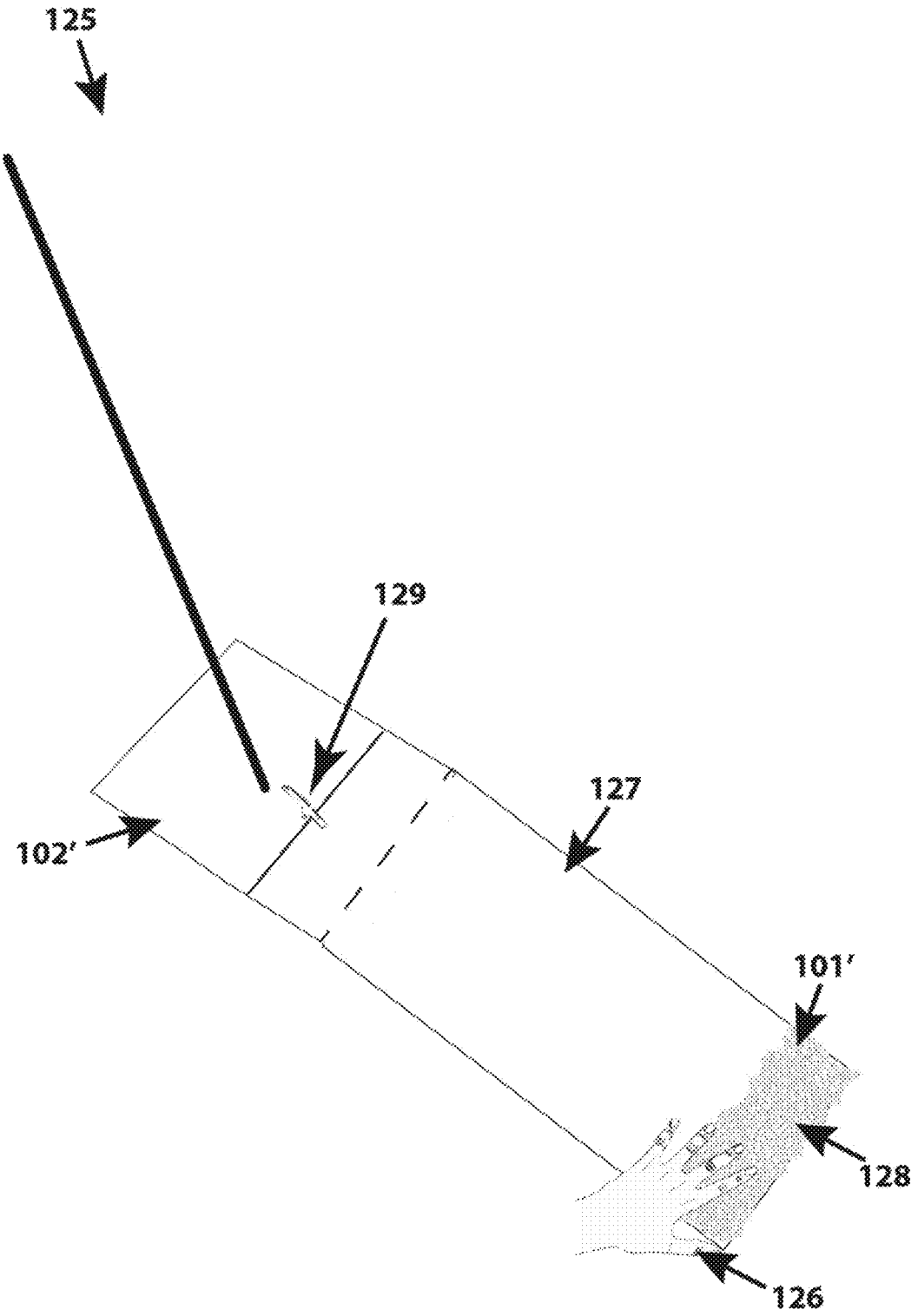
FIG. 1B is a representative example isometric view of the extendable cleaning implement of FIG. 1A with its extendable cleaning implement surface partially deployed.

FIG. 1B is a representative example 125 isometric view of the extendable cleaning implement 101' partially deployed from the mop base foot 102'. As shown in FIG. 1B, in this particular example 125, the extendable cleaning implement 101' is manually unspooled 126 by a human operator in one simple operation with the extendable cleaning implement surface 128 unrolling to directly contact the floor with the associated backing 127 top facing.

Figure 1C:
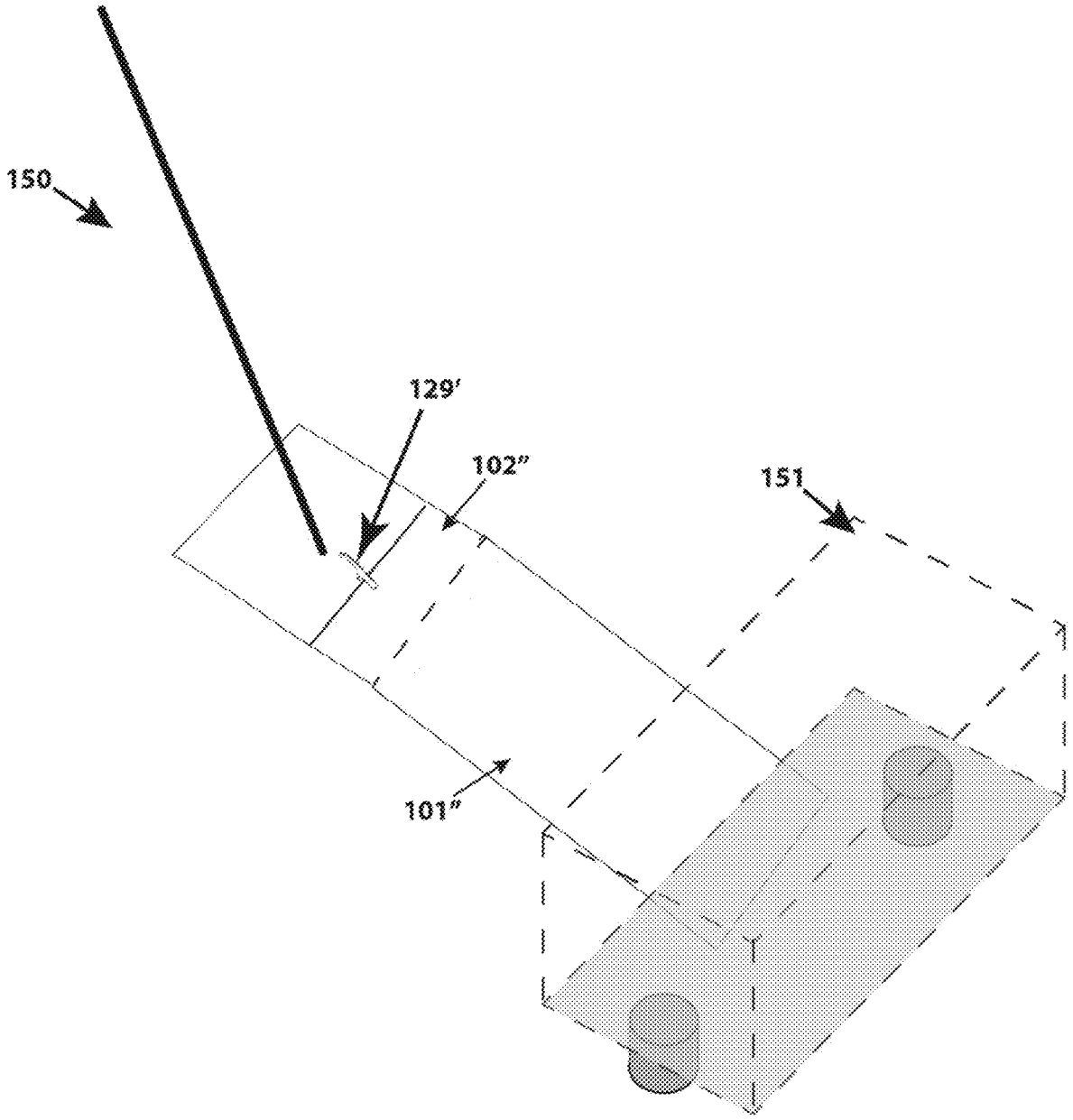
FIG. 1C is a representative example isometric view of the extendable cleaning implement of FIG. 1A with its extendable cleaning implement surface fully deployed and partially inserted under a low clearance large object.

FIG. 1C depicts a representative example 150 isometric view of the extendable cleaning implement 101" fully deployed from the mop base foot 102" that is partially underneath a large object with low clearance 151—e.g., a sofa, illustrated in phantom. As illustrated in example 125, the fully extended cleaning implement 101" slides on the floor surface in an undistorted manner thereby enabling cleaning access to the hereto inaccessible areas under the large object 151.

Figure 2A:
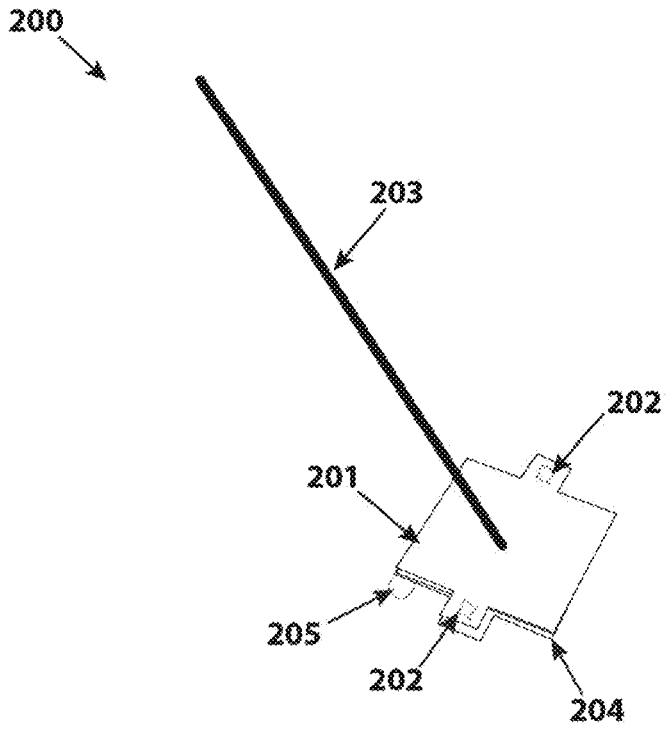
FIG. 2A is a second representative example of an isometric view of an extendable cleaning implement attached to a conventional dust mop in a folded deployment embodiment in accordance with the present invention.

FIG. 2A depicts a second, preferred, embodiment 200 of this invention principally derived from the same materials as the first embodiment 100 (FIG. 1A). However, with preferred embodiment 200 the extendable cleaning implement 201 is comprised of at least two hinged plates that may or may not be flexible by themselves. The extendable nature of this embodiment 200 being derived from the ability to unfold the hinged plates. Thus, the extendable cleaning implement 201 is stored on top of the base foot 204 of the mop in a Z-folded fashion. Again, in this embodiment 200, there is no supporting arm or backing attached to the extendable cleaning implement 201. As before, a handle 203 is attached on a pivotal mounting on the mop but in this preferred embodiment the mop handle is mounted directly on the back of a portion of the extendable cleaning implement 201.

The stored extendable cleaning implement 201 is preferably secured flexibly Z-folded on the base foot 204 of the mop via magnetic latching releasable fastener 202 thereby ensuring that the extendable cleaning implement 201 and base foot 204 remain connected together unless unlatched by the consumer by sequentially pushing down and then pulling up on the handle 203 in a rapid manner. Alternatively, a portion of the base foot 204 could be extended (extension portion 205) beyond the extendable cleaning implement 201 overhang thereby providing a place for the consumer to place their toe and hold the base foot 204 while pulling on the handle 203.

Figure 2B:
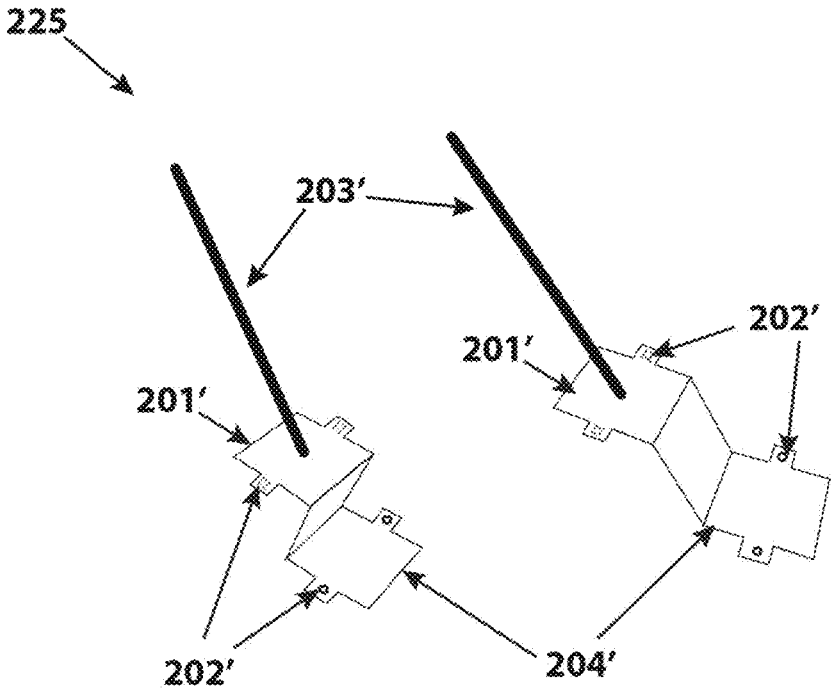
FIG. 2B shows two representative example isometric views of the extendable cleaning implement of FIG. 2A with its extendable cleaning implement surface partially deployed.
Figure 2C:
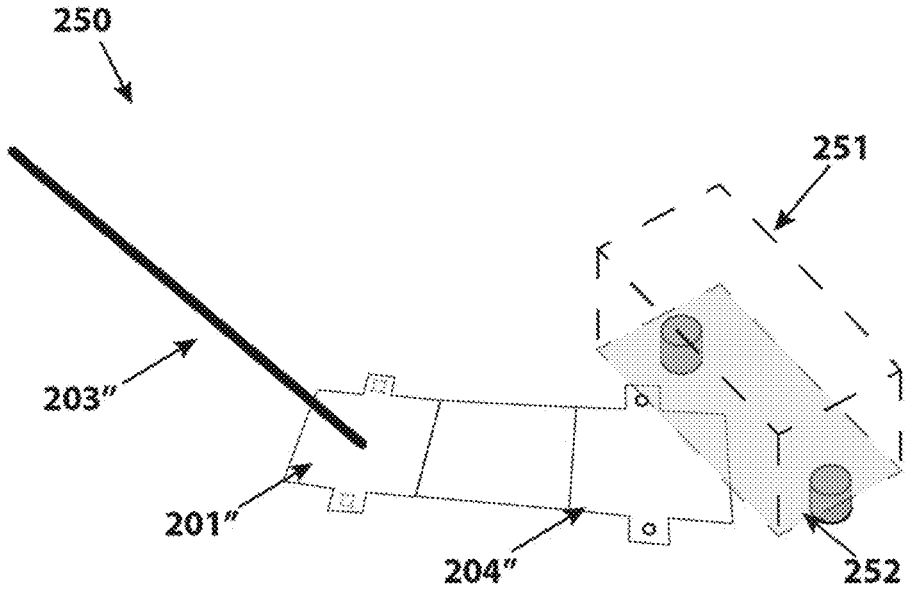
FIG. 2C is a representative example isometric view of the extendable cleaning implement of FIG. 2A with its extendable cleaning implement surface fully deployed and partially inserted under a low clearance large object shown in phantom.

Whichever method of unlatching the extendable cleaning implement 201 from the base foot 204 is employed, when the consumer unlatches the magnetic latching mechanisms 202 the folded extendable cleaning implement 201 can be unfolded and extended for use—e.g., see FIGS. 2B and 2C. After use, the consumer simply refolds the device 225 (FIG. 2B) by lifting the handle 203', positioning the extendable cleaning implement 201' on top of the base foot 204', and then pushing down to bring the magnetic latches 202' within close proximity of each other.

FIG. 2C depicts a representative example 250 isometric view of the extendable cleaning implement 201" fully deployed with the mop base foot 204" on the end of the extendable cleaning implement 201'" shown partially underneath a large object with low clearance 251—e.g., a sofa, illustrated in phantom. As illustrated in example 250, the fully extended cleaning implement 201" and 204" slides on the floor surface in an undistorted manner thereby enabling cleaning access to the hereto inaccessible areas under the large object's 251 slightly elevated base 252. As before, the extendable cleaning implement 201" and 204" is guided by the mop handle 203".

Figure 3A:
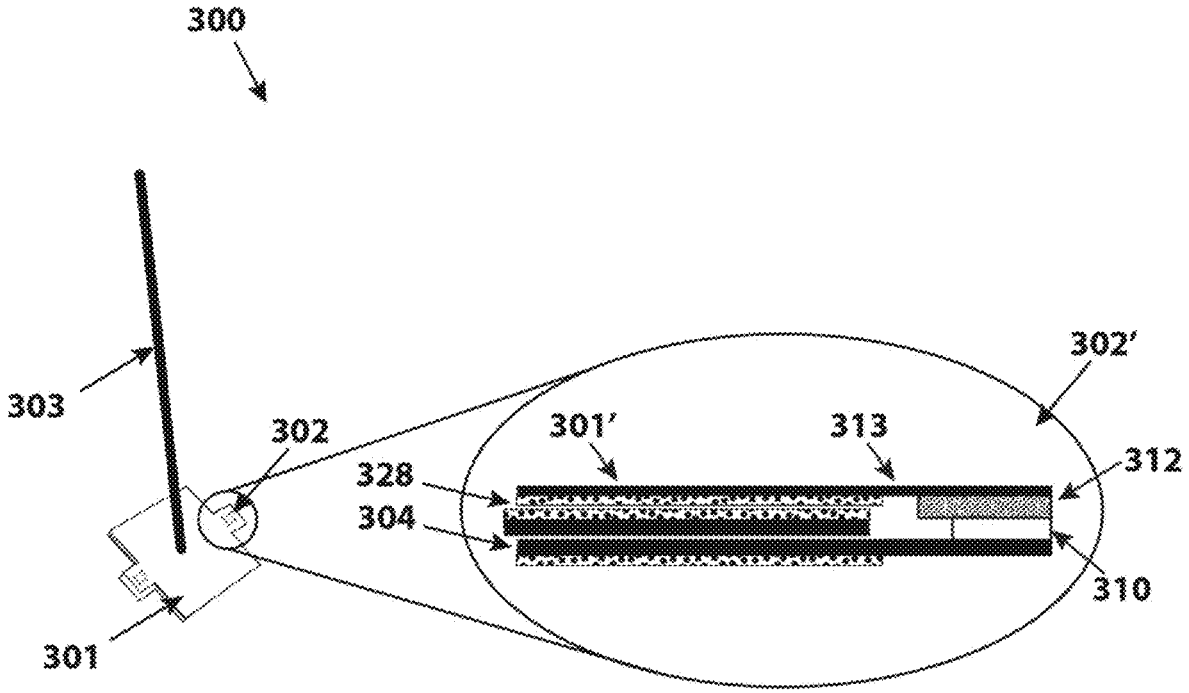
FIG. 3A is an enlarged detailed cross sectional view of the magnetic latching releasable fastener of the extendable cleaning implement of FIGS. 2A, 2B, and 2C.
Figure 3B:
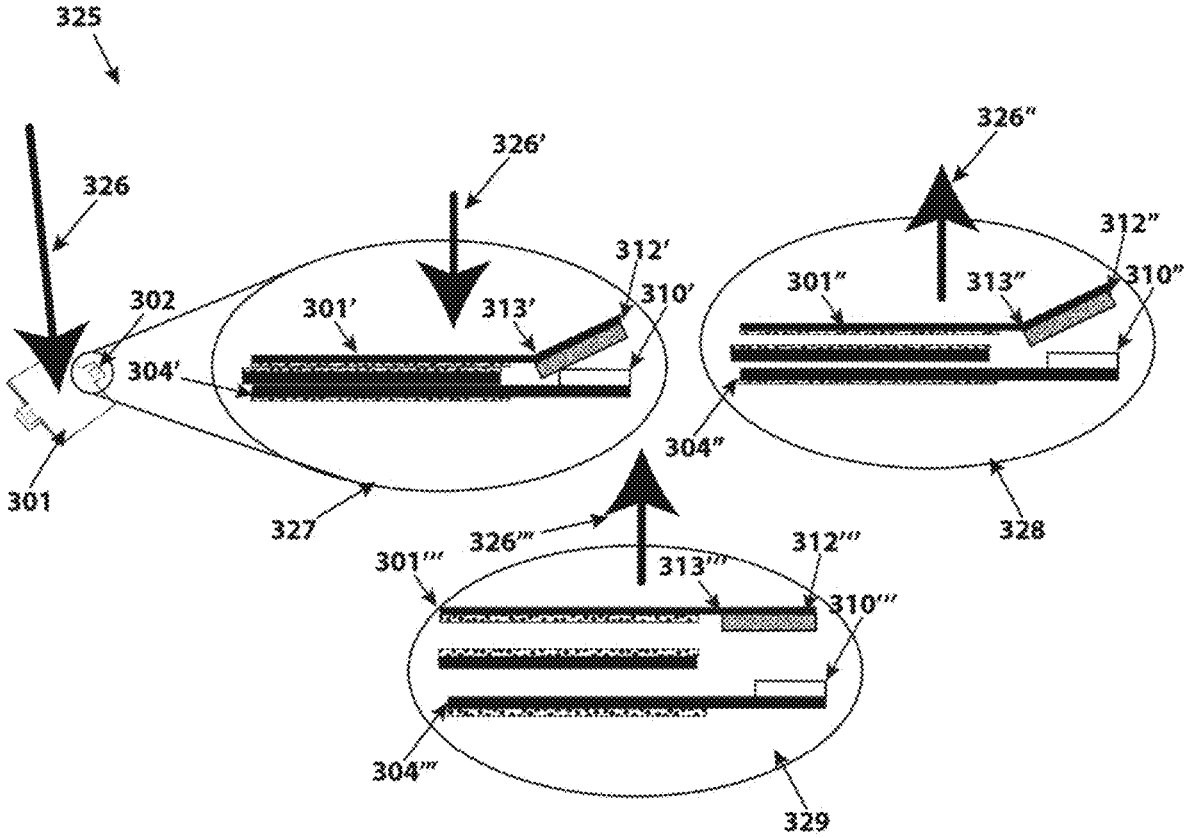
FIG. 3B is sequence of enlarged detailed cross sectional views of the magnetic latching releasable fastener of the extendable cleaning implement of FIGS. 2A, 2B, and 2C of showing the unlatching of the magnetic latching releasable fastener.
Figure 3C:
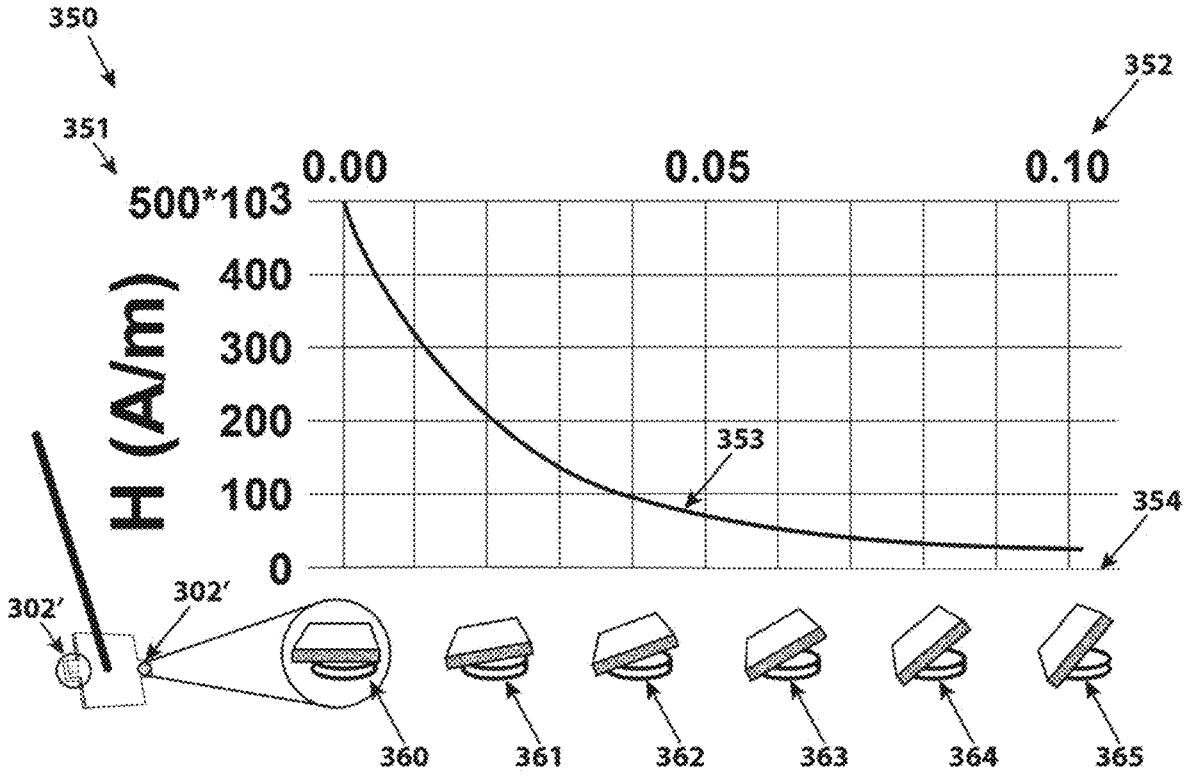
FIG. 3C is a graph of the magnetic latching releasable fastener of FIGS. 3A and 3B showing the magnetic field flux density (H) in terms of amperes per meter (A/m) versus the degree the extendable cleaning implement of FIGS. 2A thru 2C is deployed.
Figure 4:
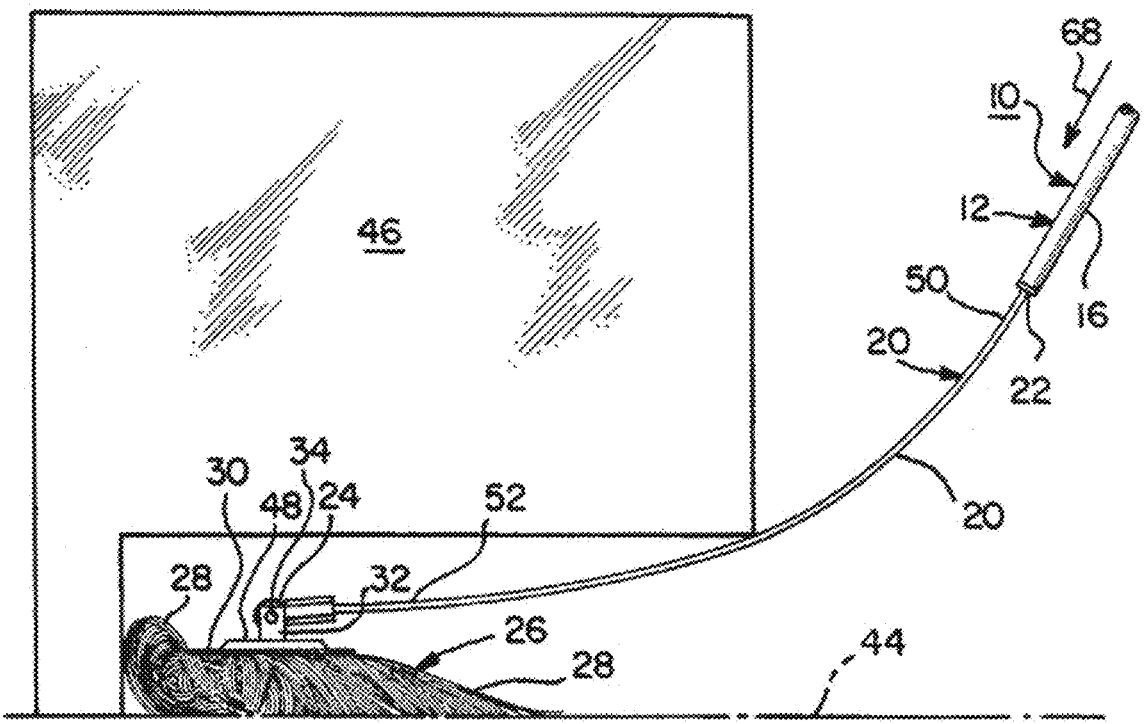
FIG. 4 is a representative example of a prior art mop flexible arm design accessing a relatively low clearance area.

FIGS. 3A, 3B, and 3C taken together illustrate one embodiment 300 of the preferred magnetic latching mechanisms (202 of FIG. 2A and 302 of FIGS. 3A and 3B) of the present invention. FIG. 3A illustrates 300 the extendable cleaning implement 301 in its stored Z-folded 302' configuration. FIG. 3B depicts various magnified views (327, 328, and 329) of the extendable cleaning implement 301 in various stages of unlatching and unfolding from the stored Z-folded position. Finally, FIG. 3C depicts a series of views of the extendable cleaning implement 301 in various stages of unlatching associated with a corresponding graph 354 depicting a curve 353 showing how magnetic field flux density ("H") in terms of Amperes per Meter ("A/m") 351 varies with the distance 352 the two magnetic latches 302' (also illustrated as 310 and 312 in FIG. 3A as well as 310', 310", 310'" and 312', 312", and 312'" of FIG. 3B) are separated from corresponding matching portions.

As shown in FIG. 3A, the extendable cleaning implement 301 is stored Z-folded, held in place by magnetic latches 302. The magnified cross portion view 302' highlights the Z-folding of the extendable cleaning implement 301' on top of the base foot 304, which is held in place by two permanent magnets of opposite polarity 310 and 312. The close proximity or direct contact between the two permanent magnets 310 and 312 creating a magnetic field "H" of sufficient strength to maintain the Z-fold storage configuration during normal handling—e.g., A/m>400. Thus, the extendable cleaning implement 301' will remain in this Z-folded configuration until the consumer applies sufficient downward force on the handle 303 to cause the hinge portion 313 of the extendable cleaning implement 301' to bend or fold.

When downward force 326 (FIG. 3B) is applied to the mop handle as shown in 325, the force impacts both the extendable cleaning surface 301 as well as the magnetic latching releasable fasteners 302. As illustrated in magnified view 327, this force compression 326' compresses the extendable cleaning implement 301' cleaning surfaces also causing the backing hinge 313' to bend or fold resulting in the magnetic latching releasable fasteners' 302 longer upper magnet 312' pivoting on its lower magnet's 310' inner edge thereby producing an air gap between portions of the upper 312' and lower 310' magnets. After applying the downward pressure 326', the consumer releases the pressure or pulls up on the handle resulting in an upward pressure 326" (see magnified view 328) causing the cleaning implement 301" cleaning surfaces to decompress and the air gap spacing between the magnetic latching releasable fasteners' 302 two magnets 312" and 310" to increase while the associated hinge 313" begins to straighten. As this upward force 326'" continues (see magnified view 329) the previously Z-folded cleaning implement 301'" cleaning surfaces separate and the air gap spacing between the magnetic latching releasable fasteners' 302 two magnets 312'" and 310'" continues to increase with the accompanying hinge 313'" straightened. Thus, the magnetic latching releasable fasteners 302 permit the cleaning implement 301 to remain Z-folded for storage and normal use, but be readily deployable for cleaning under objects with low clearance (e.g., 251 of FIG. 2C) by the consumer while standing up with a simple down and up motion initiated on the handle.

FIG. 3C provides a graphic representation 350 of how the magnetic latching releasable fastener 302' correlated magnetic flux density ("H") fields vary (in terms of Amperes per Meter—"A/m") 351 with respect to the degrees of separation (306 thru 365) of the upper and lower magnets of the magnetic latching releasable fastener 302'. As shown, these degrees of separation (306 thru 365) are also correlated as meters 352 on the corresponding graph's 354 X-axis. The resulting curve 353 illustrating a logarithmic decay as the spacing (separation) progresses from direct contact 360 to fully deployed 365 with "H" field strength below 400 A/m typically denoting the minimum value to maintain the magnetic latch in position.

Of course, there are other variations of the disclosed embodiments that would be apparent to anyone skilled in the art (e.g., a single upper or lower magnet with a corresponding ferrous material mounted on the opposite side, upper and lower magnets aligned directly with each other with the upper backing hinged further away from the magnet) in view of the present disclosure, and would be within the parameters of the appended claims.

We claim:

1. A manually operated cleaning device that extends reach and cleaning functionality to low clearance floor areas the manually operated cleaning device comprising:

(a) an extendable cleaning implement comprising:
  (i) a base foot portion, and
  (ii) at least two hinged plates attached at one end to the base foot portion, wherein the at least two hinged plates extend sequentially from the base foot portion in the same direction;

(b) an extendable cleaning surface attached to at least one side of the extendable cleaning implement, and covering a surface of (i) the base foot portion, and (ii) the at least two hinged plates;

(c) a handle attached via a pivotal mounting to the base foot portion of the extendable cleaning implement; and (d) a magnetic latching mechanism operatively coupling the the at least two hinged plates to the base foot portion and allowing extension and retraction of the extendable cleaning implement between a Z-fold stowed position on top of the base foot region when the manually operated cleaning device is not in use, and an elongated position allowing the manually operated cleaning device to access the low clearance floor areas.

2. The manually operated cleaning device of claim 1, wherein the magnetic latching mechanism is comprised of at least one magnet and a hinge portion that bends or folds.

3. The manually operated cleaning device of claim 1, wherein the magnetic latching mechanism is configured to allow the extendable cleaning implement to remain in the Z-fold stowed position unless unlatched by sequentially pushing down and then pulling up on the handle in a rapid manner.

4. The manually operated cleaning device of claim 1, wherein the magnetic latching mechanism has a minimum magnetic flux density (H) of 400 Amperes per Meter in the stowed position.

5. The manually operated cleaning device of claim 1, wherein the hinged plate that extends furthest from the base foot portion has an extension portion that provides a place to hold the hinged plate that extends furthest from the base foot portion while pulling on the handle when unlatching the extendable cleaning implement from the base foot portion.

6. The manually operated cleaning device of claim 1, wherein the base foot portion of the extendable cleaning implement is flexible.

* * * * *